US007469679B2

(12) United States Patent
Puckett et al.

(10) Patent No.: US 7,469,679 B2
(45) Date of Patent: Dec. 30, 2008

(54) METHOD FOR DETECTING AND CONTROLLING MOVEMENT OF AN ACTUATED COMPONENT

(75) Inventors: Daniel Reese Puckett, Peoria, IL (US); David John Schuh, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 561 days.

(21) Appl. No.: 11/007,202

(22) Filed: Dec. 9, 2004

(65) Prior Publication Data

US 2006/0124108 A1 Jun. 15, 2006

(51) Int. Cl.
*F02M 1/00* (2006.01)
*F02M 51/00* (2006.01)

(52) U.S. Cl. ..... 123/446; 123/480

(58) Field of Classification Search ..... 123/446, 123/478, 480, 490; 361/152–156, 160; 701/104; 73/119 A
See application file for complete search history.

(56) References Cited

U.S. PATENT DOCUMENTS

| | | | | |
|---|---|---|---|---|
| 4,130,013 | A | 12/1978 | Bailey et al. | |
| 4,206,635 | A | 6/1980 | Teerman | |
| 4,360,851 | A | 11/1982 | Zundel | |
| 4,372,266 | A | 2/1983 | Hiyama et al. | |
| 4,416,150 | A | 11/1983 | Kago et al. | |
| 4,502,439 | A | 3/1985 | Nagase et al. | |
| 4,545,530 | A | 10/1985 | Hofmann et al. | |
| 4,791,809 | A | 12/1988 | Schmidt | |
| 4,838,080 | A | 6/1989 | Okano | |
| 5,219,398 | A | 6/1993 | Nonaka et al. | |
| 5,678,521 | A | 10/1997 | Thompson et al. | |
| 5,784,245 | A * | 7/1998 | Moraghan et al. | 361/154 |
| 5,986,871 | A * | 11/1999 | Forck et al. | 361/160 |
| 5,995,356 | A | 11/1999 | Glavmo et al. | |
| 6,360,728 | B1 | 3/2002 | Sturman | |
| RE37,807 | E * | 7/2002 | Shinogle et al. | 123/480 |
| 6,725,147 | B2 * | 4/2004 | Mollin | 123/446 |
| 2003/0041658 | A1 * | 3/2003 | Leman et al. | 73/119 A |

(Continued)

FOREIGN PATENT DOCUMENTS

| | | |
|---|---|---|
| EP | 1 065 677 | 1/2001 |

(Continued)

OTHER PUBLICATIONS

Evelyn Vance et al., "Feedback Control of a Digital Hydraulic Operating System (DHOS) Diesel Injector", SAE Technical Paper Series, 2001-01-0525, Mar. 5-8, 2001.

(Continued)

*Primary Examiner*—John T Kwon
(74) *Attorney, Agent, or Firm*—Finnegan, Henderson, Farabow, Garrett & Dunner

(57) ABSTRACT

A method for detecting and controlling the position of a valve actuator is provided. The method includes applying a plurality of signals of different duration and/or magnitude to the valve actuator and measuring a signal from the valve actuator. This signal from the valve actuator is indicative of valve movement for each of the plurality of applied signals. The method further includes adjusting an injection signal to the valve actuator based at least from the measured signals from the valve actuator. This disclosure also applies this method to a solenoid actuator of a fuel injector.

47 Claims, 6 Drawing Sheets

U.S. PATENT DOCUMENTS

2003/0041843 A1* 3/2003 Shinogle ..... 123/480
2003/0200957 A1* 10/2003 Shinogle ..... 123/480

FOREIGN PATENT DOCUMENTS

EP 1 111 211 A 6/2001
EP 1 323 914 7/2003
EP 1 424 476 6/2004

OTHER PUBLICATIONS

Richard J. Hames et al., "DDEC II—Advanced Electronic Diesel Control", Technical Information Center, pp. 151-160, Apr. 26, 2004, SAE 861049.

R.J. Hames et al., "DDEC Detroit Diesel Electronic Control", Copyright 1985 Society of Automotive Engineers, Inc., complete document cited above.

* cited by examiner

METHOD FOR DETECTING AND CONTROLLING MOVEMENT OF AN ACTUATED COMPONENT

TECHNICAL FIELD

The present disclosure relates generally to a method for detecting and controlling the movement of a component of an actuator for use in a work machine, and more particularly to a valve component of a solenoid-operated actuator for use in a work machine.

BACKGROUND

Work machines utilize actuators for a number of applications. For example, fuel injectors, commonly used to deliver fuel to a combustion chamber in an internal combustion engine, utilize actuators. A fuel injector may deliver a certain quantity of fuel, which may be, for example, diesel fuel, to the combustion chamber in the engine at a certain time in the operating cycle of the engine. The amount of fuel delivered to the combustion chamber may depend on the operating conditions of the engine such as, for example, the engine speed and the engine load.

Precisely controlling the quantity and timing of the fuel delivered to each combustion chamber in the engine may lead to an increase in engine efficiency and/or a reduction in the generation of undesirable emissions. To improve control over the quantity and timing of fuel delivery, a typical fuel injection system includes an electronic control module that controls the timing and quantity of fuel delivered by a fuel injector. The electronic control module transmits a control signal to the fuel injector in the engine to deliver a certain quantity of fuel to the combustion chamber at a certain point in the operating cycle. The control module sends a signal to an actuator, typically a solenoid, of the fuel injector to control the quantity and timing of fuel injected. The control module can vary this signal in order to control the duration of solenoid activation and the control module can vary the magnetic force, or magnitude, created by the solenoid.

The solenoid controls the flow of high pressure activation fluid to the injector by opening and closing a high pressure inlet. The high pressure inlet receives a high pressure activation fluid from a high pressure supply, such as a high pressure rail, of the work machine. Typically, the solenoid controls the movement of a valve member controlling a high pressure inlet of the fuel injector. The valve member, in its first or closed position, prevents the flow of the high pressure activation fluid. When moved to a second or open position, the valve member allows the high pressure activation fluid to enter the injector. Activating the solenoid urges the valve member towards its open position, starting the injection cycle. The high pressure fluid acts within the fuel injector, causing injection of fuel to occur. Deactivating the solenoid ends the injection cycle and releases pressure caused by the high pressure fluid within the injector.

Most work machines utilize more than one combustion chamber and therefore require more than one fuel injector. The work machine typically operates most efficiently when the fuel injectors for each combustion chamber inject fuel for the same duration. Otherwise, the work machine may experience excessive power growth, greater emissions, and/or oil dilution problems. In addition, operating the fuel injectors in this manner may minimize engine noise, vibrations and harshness. To synchronize the fuel injectors within an engine, the control module has a preset profile for the fuel injectors correlating fuel quantity injected with solenoid activation duration. The amount of fuel delivered by the fuel injector depends on the movement of the valve member controlling the supply of the high pressure activation fluid. The faster or slower the valve member moves from its closed position to its open position varies the timing and amount of fuel delivered. Similarly, the amount of time the valve member takes to return to its closed position from its open position varies the timing and amount of fuel delivered.

However, no two fuel injectors perform in the same manner due to slight variations in mechanical tolerances during manufacture and the wear of components through use. This means that the same signal sent to different fuel injectors may result in a different quantity of fuel injected by each fuel injector. In addition, the timing and duration of injection may vary from injector to injector. Adjusting for these variations may improve fuel efficiency and/or reduce unwanted emissions. Typical solutions to these variations focus on understanding the valve member's motion.

U.S. Pat. No. 5,995,356 ("the '356 patent") discloses a method to detect the movement of a solenoid-operated valve element. The '356 patent discloses activating a solenoid by sending current to the solenoid to urge a valve to its open position; then deactivating the solenoid so that the valve is urged towards its closed position. At a predetermined time after deactivating the solenoid, the current in the solenoid is measured to detect a predetermined characteristic change. This predetermined characteristic change corresponds to the valve having returned to its closed position. The '356 patent also discloses a circuit solution for measuring the current in the solenoid. This circuit is an example of a free-wheel circuit, where free wheeling means the circuit has a predetermined resistance so that when the energy which is stored in the solenoid is provide to the circuit, the current can be measured. The '356 patent, however, does not disclose how to use the information collected through the disclosed method.

Another characteristic of the movement of the valve member may also cause fuel injector inefficiencies. In some instances, the differences in the motion of the valve member as it moves from its closed position to its open position influences the timing and the amount of fuel injected into the combustion chamber. Eliminating or minimizing the variation in this opening motion from fuel injector to fuel injector may decrease differences in the fuel injection rate leading to an increase in fuel efficiency and/or reduction in unwanted emissions.

The method of the present disclosure solves one or more of the problems set forth above.

SUMMARY OF THE DISCLOSURE

In accordance with one exemplary embodiment, a method for adjusting a signal delivered to a valve actuator of a fuel injector includes applying a plurality of signals of different duration or magnitude to the valve actuator. The method also provides for measuring a signal from the valve actuator indicative of a valve movement for each of the plurality of applied signals and adjusting an injection signal to the valve actuator based at least in pail on the measured signals from the valve actuator.

According to yet another embodiment, a method is provided for adjusting a signal delivered to a valve actuator of a fuel injector by periodically applying a plurality of signals of different duration or magnitude to the valve actuator and measuring a signal from the valve actuator indicative of a valve movement for each of the plurality of applied signals. The method further provides for determining a valve movement time from at least the durations or magnitudes of the plurality of applied signals and the measured signals from the valve actuator and further determining at least one offset value by comparing the valve movement to a reference valve movement profile. The method also provides for adjusting the initiation or duration of an injection signal to the valve actuator based on the at least one offset value.

DETAILED DESCRIPTION

Reference will now be made in detail to exemplary embodiments of the disclosure, illustrated in the accompanying drawings. Wherever possible, the same reference numbers will be used throughout the drawings to refer to the same or like parts.

Figure 1:
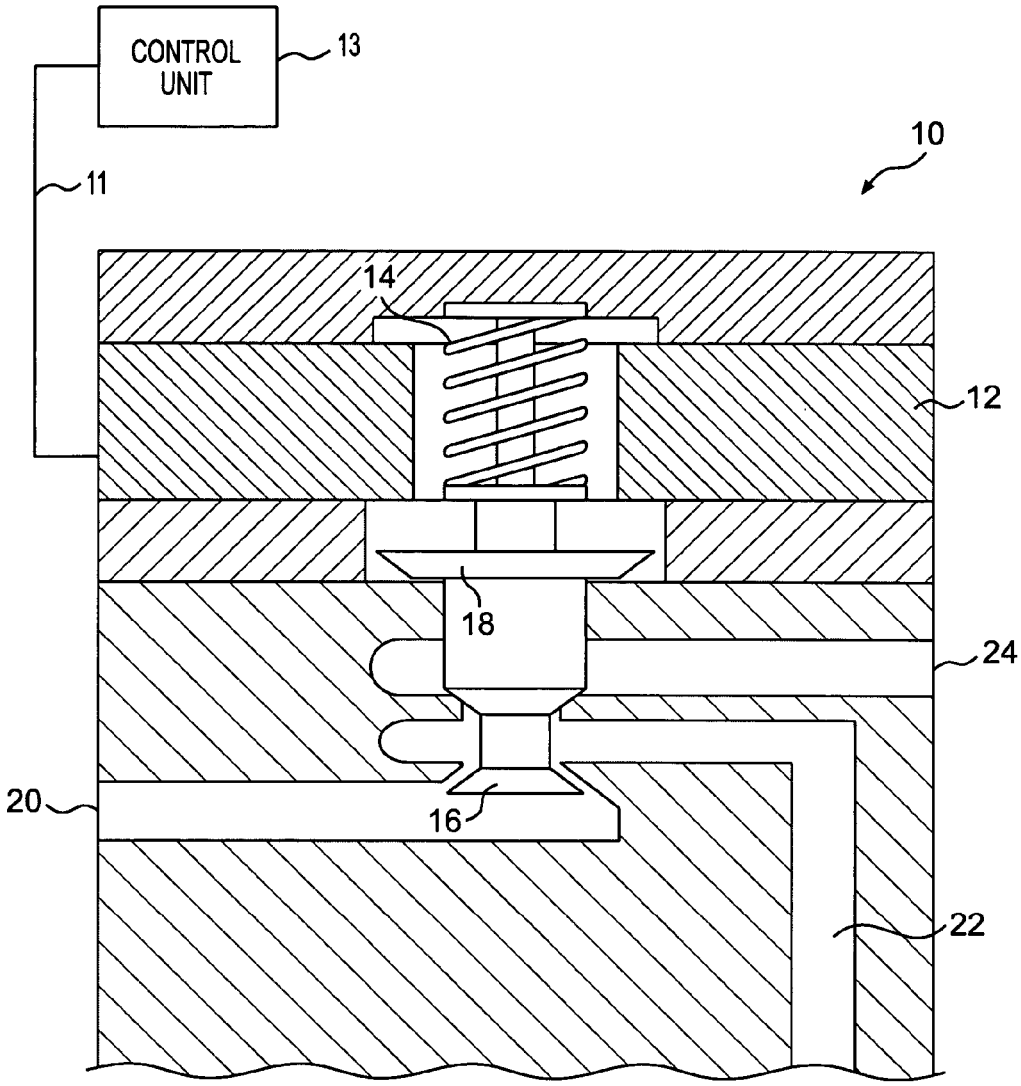
FIG. 1 is a partial diagrammatic cross-sectional side view of an actuator assembly of an exemplary fuel injector in accordance with the present disclosure.

Referring to the figures, an actuator assembly 10 of a common rail fuel injector is shown generally in FIG. 1. Actuator assembly 10 may include a solenoid 12, a bias spring 14, a valve member 16, an armature 18, a control wire 11 connected to an actuator assembly control unit 13, a low pressure drain passage 20, an internal injector passage 22, and a high pressure activation fluid inlet 24. Internal injector passage 22 may communicate with a nozzle tip (not shown) of the fuel injector for injecting activation fluid into a combustion chamber of an engine. It should be understood, however, that the method disclosed here is not limited for use with this particular actuator assembly. It should be understood that the method of this disclosure may be performed with any electronically controlled valve for communicating a fluid to, or within, a fuel injector, including but not limited to admission valves, spill valves, check control valves, such as those used in but not limited to hydraulically actuated fuel injectors, mechanically activated fuel injectors, and common rail fuel injectors.

The bias spring 14 may bias armature 18, connected to valve member 16, downward, biasing valve member 16 towards a first or closed position. When activated, the solenoid 12 urges armature 18 and valve member 16 upwards, urging valve member 16 towards a second or open position.

In its closed position, valve member 16 prevents the high pressure activation fluid in high pressure activation fluid inlet 24 from communicating with internal injector passage 22 or low pressure drain passage 20 of actuator assembly 10. Also, when valve member 16 is in its closed position, internal injector passage 22 fluidly communicates with low pressure drain passage 20. When valve member 16 is in its open position, high pressure activation fluid from high pressure activation fluid inlet 24 can communicate with internal injector passage 22.

Figure 2:
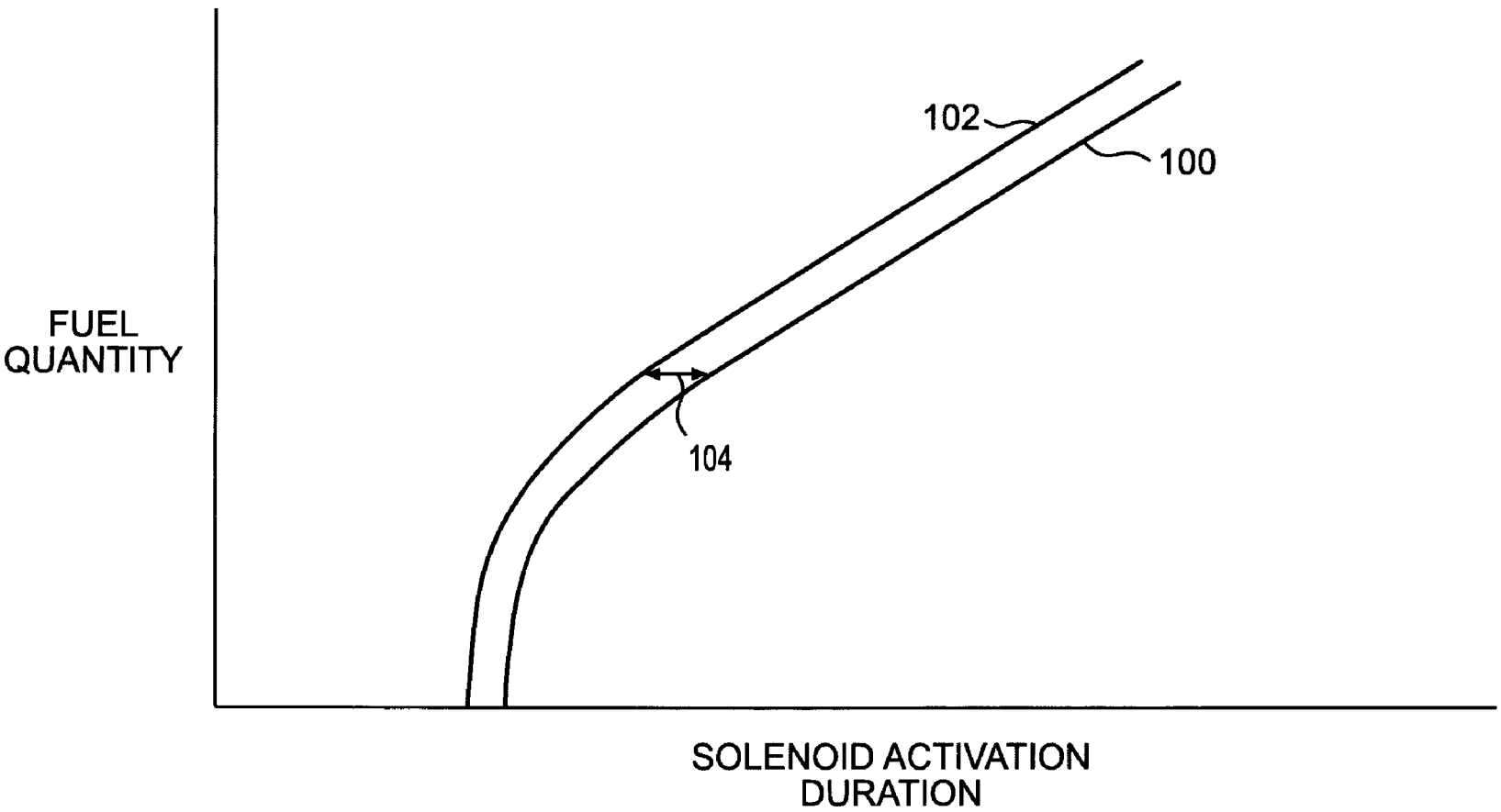
FIG. 2 is a graphic illustration of fuel quantity injected as a function of solenoid activation duration in accordance with the present disclosure.

The control unit 13 may contain a reference profile for actuator assembly 10 that is programmed into the control unit 13 when the actuator assembly 10 is installed. The manufacturer may create this reference profile by testing a nominal fuel injector and determining at least its injection, timing, and duration characteristics. An exemplary reference profile is illustrated in FIG. 2 at 100, where fuel quantity injected versus solenoid activation duration is shown. Reference profile 100 corresponds to the expected quantity of fuel injected by actuator assembly 10 for a given solenoid activation duration at a certain rail pressure when activated by the control unit 13. The control unit 13 may contain a reference profile 100 for each actuator assembly 10 of the work machine and may include profiles for various possible rail pressures. In addition, the control unit 13 may extrapolate fuel quantity as a function of solenoid activation duration for other rail pressures not profiled. Using reference profile 100 or another profile, the control unit 13 may determine an appropriate signal duration to be sent to solenoid 12 to obtain a desired quantity of fuel injected at the measured rail pressure. The control unit 13 also receives signals from solenoid 12 and performs any necessary calculations for adjusting the current signal sent to the solenoid 12, as will be described in more detail below. It should be understood that more than one control unit 13 may be used to control activation of solenoid 12, for receiving current from solenoid 12, and for performing any necessary calculations for adjusting the current signal sent to solenoid 12.

After determining the desired solenoid activation duration from reference profile 100 or another profile based on rail pressure and desired fuel quantity, the control unit 13 for actuator assembly 10 initiates injection by sending a current signal to solenoid 12. Referring to FIG. 1, activating solenoid 12 generates an electromagnetic field urging armature 18, connected to valve member 16, upwards and moves valve member 16 towards its open position. When valve member 16 starts moving towards its open position, the high pressure activation fluid in high pressure activation fluid inlet 24 can communicate with internal injector passage 22. As noted above, internal injector passage 22 may be configured to supply the high pressure activation fluid to the nozzle tip of the injector (not shown) for injecting into a combustion chamber of the engine of the work machine. To end injection, the control unit 13 deactivates solenoid 12 by stopping the current signal to the solenoid 12, with the duration of the signal being determined by the reference profile 100. Without the electromagnetic force of solenoid 12 acting on armature 18, bias spring 14 urges armature 18 downward, moving valve member 16 towards its closed position. In its closed position, valve member 16 prevents the high pressure activation fluid in high pressure activation fluid inlet 24 from communicating with internal injector passage 22. In its closed position, valve member 16 allows communication between internal injector passage 22 and low pressure drain passage 20. This results in a lowering of the pressure in the internal injector passage 22 and in the nozzle of the injector.

Due to manufacturing tolerances and the wear of mechanical parts through continued use, the quantity of fuel injected may vary from fuel injector to fuel injector. For example, two fuel injectors having actuator assemblies that are energized for the same duration may supply two significantly different quantities of fuel. Furthermore, these variations may cause both the start and the end of injection to occur at different times because the movement of the valve member 16 may deviate from the reference profile 100 due to the differences in manufacturing tolerances and the wear of parts through use. As will be discussed in more detail below, an adaptive trim sweep may help to determine deviations from the reference profile 100. In addition, the adaptive trim sweep may assist in creating an adaptive trim profile that can be used to adjust the duration and timing of solenoid activation in order to compensate for actuator variations and more particularly, control the timing and quantity of fuel injected.

First, the control unit 13 determines whether the conditions to run the adaptive trim sweep are met. These conditions may include, but are not limited to, whether an actuator assembly 10 has reached a predetermined age and/or whether an actuator assembly 10 was replaced. The adaptive trim sweep may be designed to only run if these or other conditions are satisfied. Other conditions, such as engine load or engine run-time may also be used to determine when to run the adaptive trim sweep. In the exemplary method, the pressure of the high pressure activation fluid is held near constant during the adaptive trim sweep. If the rail pressure deviates outside a predetermined range during the adaptive trim sweep, the control unit 13 will terminate the adaptive trim sweep.

Figure 3A:
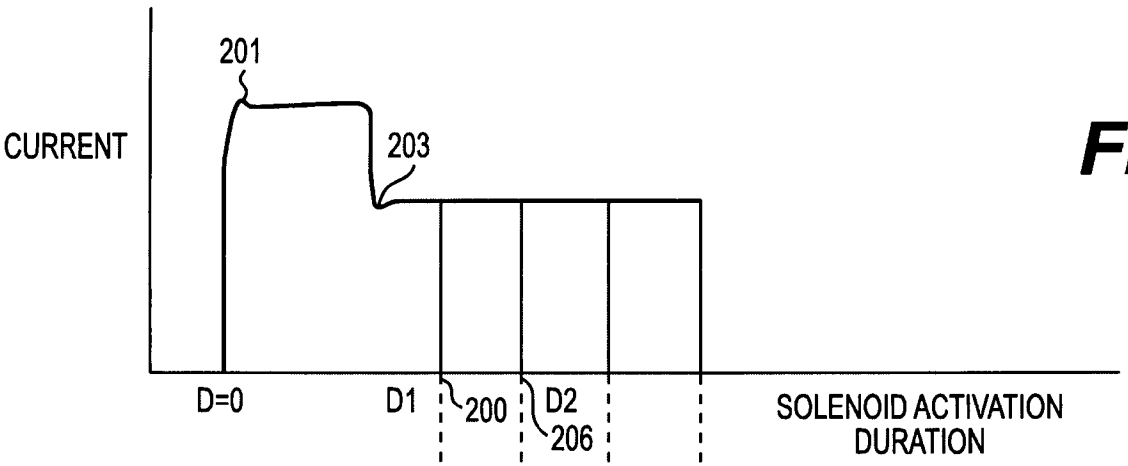
FIG. 3*a* is a graphic illustration of applied current as a function of solenoid activation duration in accordance with the present disclosure.

FIG. 3*a* graphically illustrates current as a function of solenoid activation duration where current is shown on the vertical axis and solenoid activation duration is shown on the horizontal axis. To run the adaptive trim sweep of actuator assembly 10, the control unit 13 sends a current signal to solenoid 12 for a first duration (D1), shown at 200 in FIG. 3*a*, to urge the valve member 16 towards its open position. The magnitude of the current signal sent to solenoid 12 is initially high, as seen at 201 in FIG. 3*a*, in order to quickly create a solenoid electromagnetic force strong enough to overcome the bias force from bias spring 14 acting upon armature 18 and valve member 16. After a predetermined time corresponding to an initial movement of valve member 16 towards its open position, the magnitude of the current signal to solenoid 12 is decreased to a level that will continue to urge valve member 16 towards its open position as seen at 203. When duration (D1) ends, shown at 200, the control unit 13 ends the current signal to solenoid 12. This allows the electromagnetic force created by solenoid 12 to dissipate, allowing bias spring 14 to bias armature 18 and valve member 16 towards its closed position.

Figure 3B:
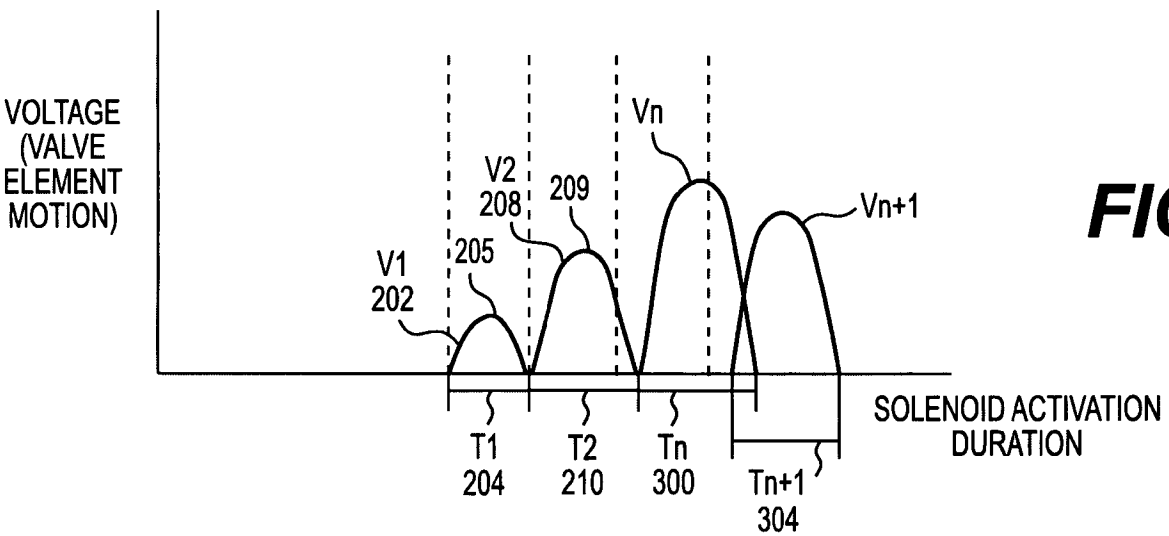
FIG. 3*b* is a graphic illustration of measured voltage indicative of the motion of a valve element as a function of solenoid activation duration in accordance with the present disclosure.

Upon ending the signal duration (D1) 200, the current in solenoid 12 is then routed into a free-wheel circuit (not shown) after a pre-determined delay and a first induced voltage (V1), shown at 202 in FIG. 3*b*, is measured. The first induced voltage (V1) 202 is indicative of valve member 16 movement from its partially open position to its fully closed position for the current signal applied for duration (D1). Using the first induced voltage (V1) 202, the control unit 13 can extrapolate valve member 16 motion as a function of solenoid activation duration (D1), as graphically illustrated in FIG. 3*b*, where valve member 16 motion is shown on the vertical axis and solenoid activation duration is shown on the horizontal axis. A first time (T1), shown at 204 in FIG. 3*b*, is computed from the end of duration (D1), shown at 200, to the end of valve member 16 motion shown at 205.

Next, the control unit 13 sends a second current signal to the solenoid 12 for a second duration (D2), shown at 206 in FIG. 3*a*, such that the second duration (D2) 206 is longer than the first duration (D1) 200. Upon ending the second current signal at the end of second duration (D2) 206, the remaining current in the solenoid 12 is again routed into the free-wheel circuit and a second induced voltage (V2) is measured. The second induced voltage (V2) is indicative of valve member 16 movement from its partially open position to its fully closed position for the current signal applied for duration (D2). From this voltage (V2), the control unit 13 extrapolates valve member 16 motion as a function of solenoid activation duration (D2) as seen in FIG. 3*b* at 208. A second time (T2), shown at 210 in FIG. 3*b*, is computed from the end of duration (D2) to the end of valve member 16 motion shown at 209 .

The control unit 13 then compares the time values (T1) and (T2) for each duration (D1) and (D2). If the time value (T2) is greater than the time value (T1), the control unit 13 continues running the adaptive trim sweep with additional current signals with increasing solenoid activation durations. The control unit 13 continues this adaptive trim sweep until an initial peak duration 302 in FIG. 4 is identified.

Figure 4:
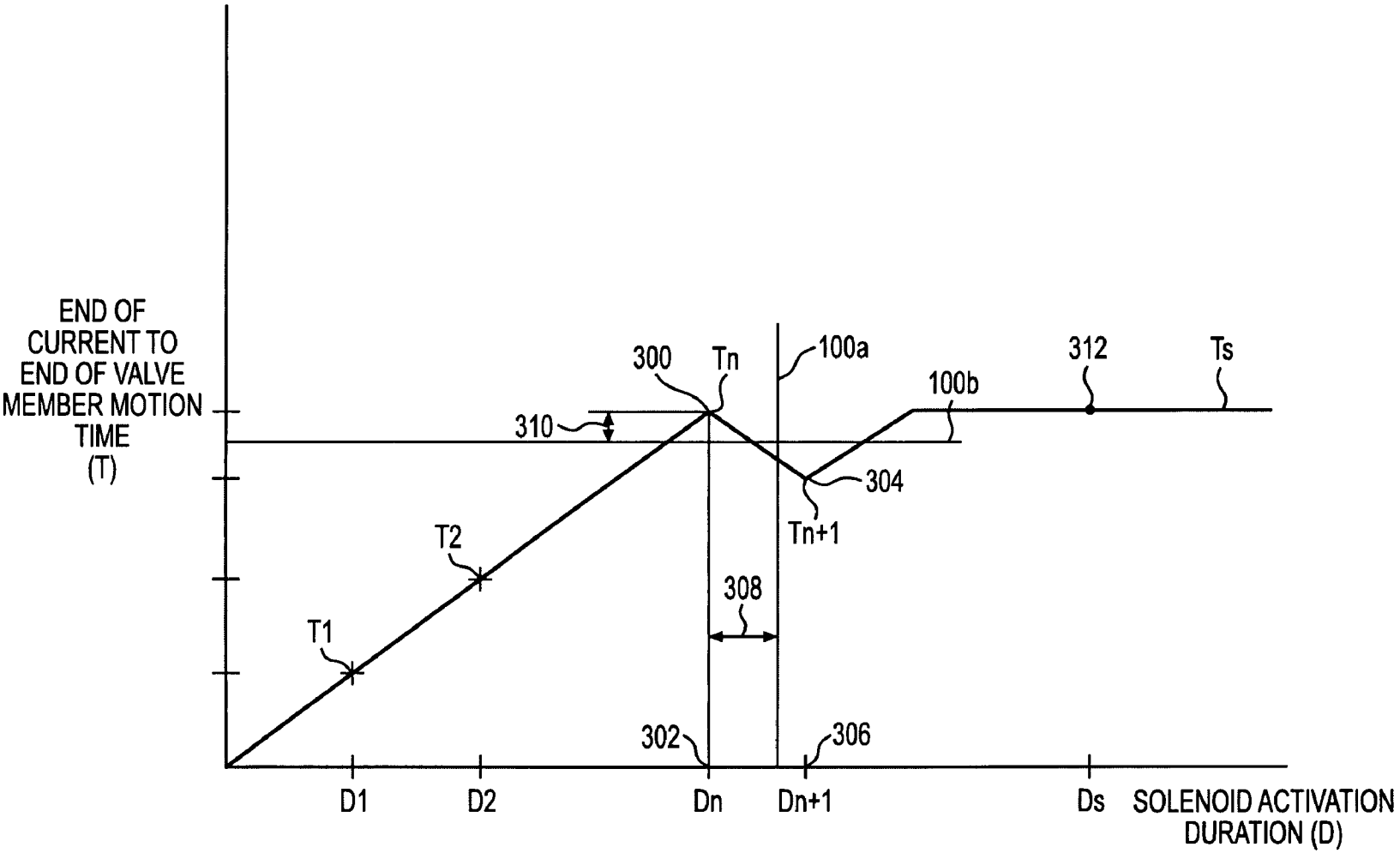
FIG. 4 is a graphic illustration of measured time as a function of solenoid activation duration in accordance with the present disclosure.

FIG. 4 graphically illustrates the identification of an initial peak duration by plotting the time from end of current to end of valve member 16 motion as a function of solenoid activation duration. Time is plotted on the vertical axis and solenoid activation duration is plotted on the horizontal axis. Initial peak duration 302 occurs the first time value (Tn), shown at 300 in FIG. 4, from duration (Dn), shown at 302 in FIG. 4, is greater than the time value (Tn+1), shown at 304 in FIG. 4, from duration (Dn+1), shown at 306 in FIG. 4, where (n) represents an iteration and (n+1) represents one iteration occurring directly after iteration (n). This peak duration 302 corresponds to the first time the applied current is sufficient to move valve member 16 to its fully open position. The reduction in time (Tn+1) 304 compared to time (Tn) 300 corresponds to valve member bounce. Valve member bounce occurs when the valve member 16 is urged towards its open position by solenoid 12 at such a velocity that the valve member 16 hits its fully open position and bounces away from its fully open position. As it bounces away toward its closed position, the velocity of the return motion is higher causing a reduction in return time. To locate the peak duration (Dn) 302 corresponding to valve member 16 reaching its fully open position, the control unit 13 performs the adaptive trim sweep until time (Tn+1) 304 and time (Tn) 300 are found.

During installation of the actuator assembly 10, a reference minimum duration, shown at 100*a* in FIG. 4, and a reference return time, shown at 100*b* in FIG. 4, are also programmed into the control unit. The manufacturer may determine these values by testing a representative fuel injector. The reference minimum duration 100*a* indicates a predetermined minimum solenoid activation duration required to urge valve member 16 from its fully closed position to its fully open position at a certain rail pressure. The reference return time 100*b* corresponds to a predetermined return time required for bias spring 14 to bias valve member 16 from its fully open position to its fully closed position for a given rail pressure. This reference return time 100*b*, therefore, corresponds to difference between the end of the current signal and the end of valve member 16 motion.

Once the peak duration (Dn) 302 is found, the control unit 13 determines how the actuator assembly 10 deviates from the reference profile 100. The control unit 13 determines a start trim offset value 308 from the difference between solenoid activation duration corresponding to the peak duration 302 and the reference minimum duration 100*a*. The start trim offset value 308 is indicative of how the movement of valve member 16 from its fully closed position to its fully open position deviates from reference minimum duration 100*a*. The control unit 13 also determines an end trim offset value 310 from the difference between the end of current to end of valve member 16 motion and reference return time 100*b* as shown at 310. The end trim offset value 310 is indicative of how movement of valve member 16 from its fully open position to its fully closed position deviates from reference return time 100*b*. Alternatively, end trim offset value 310 may be determined as the difference between reference time 100*b* and a duration (Ds) at a time (Ts), shown at 312 in FIG. 4, after peak duration (Dn) 302. Time (Ts) 312 is indicative of the time required for bias spring 14 to bias valve member 16 from its fully open position to its fully closed position after valve member 16 has reached and remained in its fully open position. Time (Ts) 312 can be found when time (Ts) 312 at duration (Ds) is greater than time (Tn+1) 304 at duration (Dn+1) 306, where duration (Ds) is greater than duration (Dn+1) 306. This time (Ts) 312 deviates from the reference return time 100*b* in part because of the wear of mechanical parts through use and because of the limitations of manufacturing tolerances. The faster valve member 16 returns to its fully closed position, the less fuel will be injected into the combustion chamber. The longer valve member 16 takes to travel from its fully open to its fully closed position increases the amount of fuel injected into the combustion chamber.

Figure 5A:
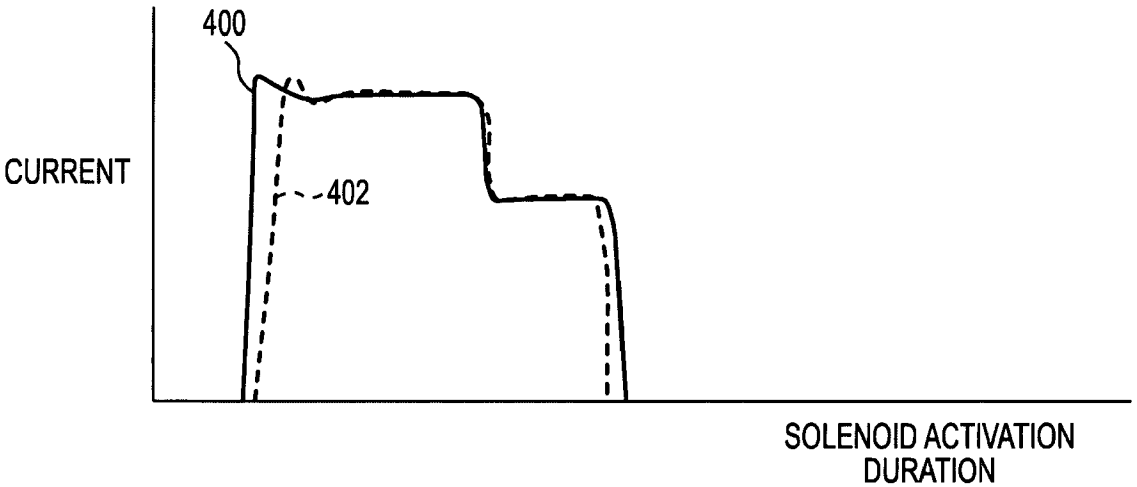
FIG. 5*a* is a graphic illustration of current as a function of solenoid activation duration in accordance with the present disclosure.

Referring back to FIG. 2, the control unit 13 adds the trim values 308, 310, together to get a final trim value 104 to correct differences between reference profile 100 and an adaptive trim profile 102. This calculated trim 104 when applied will cause the injector profile 102 to overlay the reference profile 100. The calculated trim values 308, 310 enable the control unit 13 to adjust the duration of solenoid activation in order to obtain injection of a desired quantity of fuel at a particular rail pressure. The control unit 13 can extrapolate an adaptive trim profile for other rail pressures in order to adjust solenoid activation duration and more accurately inject a determined quantity of fuel over an entire range of rail pressures. This is graphically illustrated in FIG. 5*a* showing current as a function of solenoid activation duration. A reference current as a function of solenoid activation duration is shown at 400 and the adaptive trim profile is shown at 402. As illustrated in FIG. 5*a*, adaptive trim profile 402 has a shorter duration than the reference duration 400 and therefore the valve member 16 associated with the adaptive trim profile 402 has a faster opening and closing time than the reference opening and closing time. In this example, a faster valve member 16 would be activated for a shorter duration than the reference duration in order to injected the same fuel quantity.

Figure 5B:
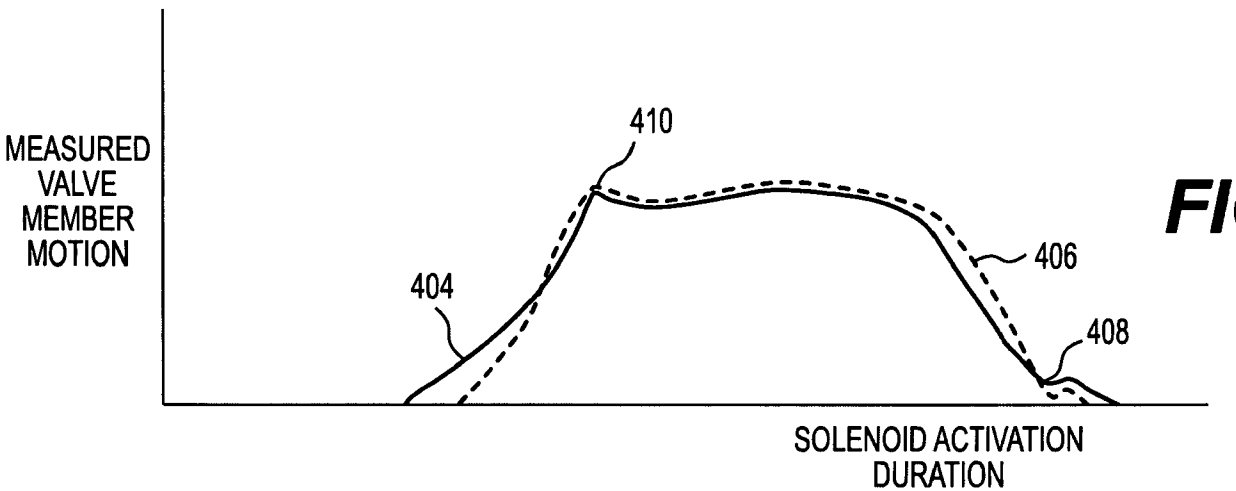
FIG. 5*b* is a graphic illustration of measured motion of a valve element as a function of solenoid activation duration in accordance with the present disclosure.

This adaptive trim profile 402 enables the control unit 13 to more accurately control the start and the end of injection. This is graphically illustrated in FIG. 5*b* showing valve member 16 motion as a function of solenoid activation duration. A reference valve member motion is shown at 404 and the adaptive trim profile is shown at 406. By adjusting the timing and the solenoid activation duration based on the adaptive trim profile 402 in FIG. 5*a*, the control unit 13 can end valve motion at the same time as the reference profile 404, as illustrated at point 408 in FIG. 5*b*. Similarly, the control unit 13 can adjust the timing and solenoid activation duration to end valve motion in its fully open position at the same time as the reference profile 404, as illustrated at point 410 in FIG. 5*b*. To do this, the control unit 13 utilizes adaptive trim profile 406, to synchronize the time when valve member 16 reaches its closed position 408 with the time value from the reference profile 404. This may require the control unit 13 to deactivate solenoid 12 before the reference profile 404 would normally require or it may require the control unit 13 to keep solenoid 12 active longer than the reference profile 404 would require depending on whether the valve member 16 travels faster or slower from its open position to its closed position than the reference time. In the example illustrated in FIG. 4, the injector takes longer to go from its fully open to its fully closed position than the reference. To end injection at the same point, the control unit 13 would end the current to the injector in FIG. 4 sooner than the reference in FIG. 4. This difference in timing is illustrated in FIG. 5*a*. Similarly, to start injection at the same point, the control unit 13 alters when the solenoid actuation begins to align the time when the valve member reaches its fully open position 410.

The control unit 13 may perform the adaptive trim sweep profile for each fuel injector within the engine of the work machine. Furthermore, the control unit 13 may create an adaptive trim profile for each injector. Using the adaptive trim profile for each injector, the control unit 13 can synchronize the end of injection for multiple fuel injectors by more accurately controlling the movement of each valve member.

INDUSTRIAL APPLICABILITY

Figure 6:
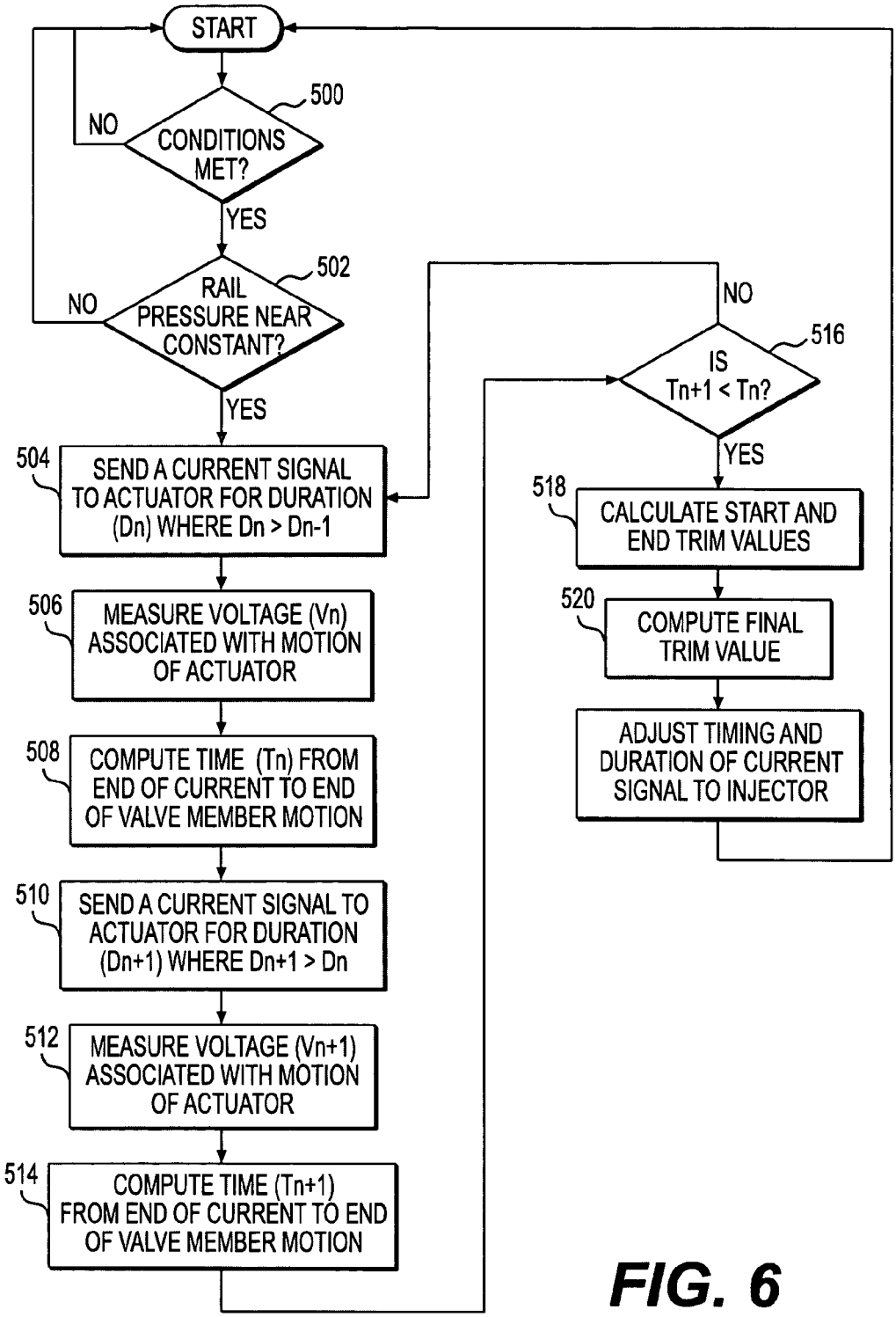
FIG. 6 is a flowchart illustrating an exemplary method for performing an adaptive trim sweep and creating an adaptive trim profile for an actuator assembly of a fuel injector in accordance with the present disclosure.

The flowchart of FIG. 6 illustrates an exemplary method for an adaptive trim sweep and for creating an adaptive trim profile. First, the control unit 13 determines whether the conditions for running the adaptive trim sweep are met. As noted above, these conditions may include whether actuator assembly 10 has reached a predetermined age and/or whether actuator assembly 10 was replaced. (Step 500). The control unit 13 next determines whether rail pressure is near constant. If the rail pressure is not near constant, the adaptive trim sweep will terminate. (Step 502). To start the adaptive trim sweep, the control unit 13 sends a current signal for duration (Dn) 302 to solenoid 12 to urge valve member 16 towards its open position. Duration (Dn) 302 is greater than (Dn−1). (Step 504). The control unit 13 will end the current signal after duration (Dn) 302 and measure the induced voltage (Vn) from solenoid 12, indicative of valve member 16 movement, in the free-wheel circuit. (Step 506). Using the induced voltage (Vn), the control unit 13 next computes time (Tn) from the end of duration (Dn) 302 to the end of valve member 16 motion. (Step 508). Time (Tn) is indicative of the time required for valve member 16 to return to its closed position from its open position after duration (Dn) 302 ends.

The control unit 13 sends a second current signal to solenoid 12 for duration (Dn+1) 306, where duration (Dn+1) 306 is greater than duration (Dn) 302. (Step 510). At the end of duration (Dn+1) 306, the control unit 13 ends the current signal sent to solenoid 12 and measures an induced voltage (Vn+1) from solenoid 12 in the free wheel circuit. (Step 512). Using the induced voltage (Vn+1), the control unit 13 computes a time (Tn+1) 304 from the end of duration (Dn+1) 306 to the end of valve member 16 motion. Time (Tn+1) 304 is indicative of the time required for valve member 16 to return to its closed position from its open position after duration (Dn+1) 306 ends. (Step 514).

Next, the control unit 13 compares the two time values (Tn) 300 and (Tn+1) 304. If (Tn+1) 304 is less than (Tn) 300, a peak duration 302, corresponding to the first time valve member 16 is in its fully open position, occurs at duration (Dn) 302. If (Tn+1) 304 is greater than (Tn) 300, the control unit 13 will repeat the adaptive trim sweep. (Step 516). If a peak duration 302 is found at time (Tn) 300, the control unit 13 next determines a start trim offset value 308 and an end trim offset value 310. (Step 518). The start trim offset value 308 corresponds to the difference between the reference duration and the adaptive trim sweep duration (Dn) 302 for valve member 16 to travel from its fully closed position to its fully open position after the current signal is sent to solenoid 12. The control unit 13 determines the start trim offset value 308 as the difference between the peak duration (Dn) 302 and a reference minimum duration 100*a* (FIG. 4). The end trim offset value 310 corresponds to the difference between the measured time (Tn) for valve member 16 to travel from its fully open position to its fully closed position after the current signal to solenoid 12 ends and a reference time 100*b* (FIG. 4). The control unit 13 determines end trim offset value 310 as the difference between time (Tn) and reference return time 100*b*. Using the start and end trim offset values 308 and 310, the control unit 13 determines the final trim valve 104 to correct differences between reference profile 100 and an adaptive trim profile 102. (Step 520). In addition, the control unit 13 can extrapolate fuel quantity injected as a function of solenoid activation duration for other rail pressures. Now the control unit 13 can use the desired quantity of fuel to be delivered and the rail pressure to find a corresponding solenoid activation duration for valve member 16 from the adaptive trim profile 102. This enables the control unit 13 to more accurately control the timing and quantity of fuel injected.

As noted above, the control unit 13 can use the method disclosed here for one actuator assembly at a time, or on multiple actuator assemblies at the same time. The control unit 13 may contain a reference profile for each actuator assembly and can create a reference profile for all of the actuator assemblies based on these individual reference profiles.

Other embodiments of the disclosure will be apparent to those skilled in the art from consideration of the specification and practice of the disclosure discussed herein. It is intended that the specification and examples be considered as exemplary only, with a true scope and spirit of the disclosure being indicated by the following claims and their equivalents.

What is claimed is:

1. A method for adjusting a signal delivered to a valve actuator of a fuel injector, comprising:

applying a plurality of signals of different duration or magnitude to the valve actuator;

measuring a signal from the valve actuator for each of the applied signals, each measured signal from the valve actuator occurring after a termination of the associated applied signal and being indicative of a valve movement for the associated applied signal; and adjusting an injection signal to the valve actuator based at least in part on the measured signals from the valve actuator.

2. The method of claim 1, wherein the plurality of applied signals of different duration or magnitude include at least two signals of different duration and the same magnitude.

3. The method of claim 2, wherein the adjusting of the injection signal to the valve actuator includes determining at least one offset value from at least the durations or magnitudes of the plurality of applied signals and the measured signals from the valve actuator, and the adjusting of the injection signal being related to the at least one offset value.

4. The method of claim 3, wherein the plurality of applied signals are applied after the valve actuator is replaced.

5. The method of claim 4, wherein the measured signal from the valve actuator is measured in a free wheel circuit.

6. The method of claim 5, wherein the valve actuator is a solenoid.

7. The method of claim 6, wherein the plurality of applied signals are a plurality of currents applied to the solenoid.

8. The method of claim 7, wherein the adjusting of the injection signal to the valve actuator includes adjusting the timing and duration of the injection signal.

9. The method of claim 3, wherein the adjusting of the injection signal to the valve actuator maintains an end of an injection within a predetermined period of time.

10. A method for adjusting a signal delivered to a valve actuator of a fuel injector, comprising:

applying a plurality of signals of different duration or magnitude to the valve actuator;

measuring a signal from the valve actuator for each of the applied signals, each measured signal from the valve actuator occurring after a termination of the associated applied signal and being indicative of a valve movement for the associated applied signal; and adjusting a magnitude of an injection signal to the valve actuator based at least in part on the measured signals from the valve actuator.

11. The method of claim 10, wherein the plurality of applied signals of different duration or magnitude include at least two signals of different duration and the same magnitude.

12. The method of claim 11, wherein the adjusting of the magnitude of an injection signal to the valve actuator includes determining at least one offset value from at least the durations or magnitudes of the plurality of applied signals and the measured signals from the valve actuator, and the adjusting of the injection signal to compensate for the at least one offset value.

13. The method of claim 12, wherein the plurality of applied signals are applied after the valve actuator is replaced.

14. The method of claim 13, wherein the measured signal from the valve actuator is measured in a free wheel circuit.

15. The method of claim 14, wherein the valve actuator is a solenoid.

16. The method of claim 15, wherein the plurality of applied signals of different duration or magnitude are a plurality of currents applied to the solenoid.

17. The method of claim 12, wherein the adjusting of the injection signal maintains an end of an injection within a predetermined period of time.

18. A method for adjusting a signal delivered to a valve actuator of a fuel injector, comprising:

applying a plurality of signals of different duration or magnitude to the valve actuator;

measuring a signal from the valve actuator for each of the applied signals, each measured signal from the valve actuator occurring after a termination of the associated applied signal and being indicative of a valve movement for the associated applied signal; and adjusting a timing of an injection signal to the valve actuator based at least in part on the measured signals from the valve actuator.

19. The method of claim 18, wherein the plurality of applied signals include at least two signals of different duration and the same magnitude.

20. The method of claim 19, wherein the adjusting of the timing of the injection signal of the valve actuator includes determining at least one offset value from at least the durations or magnitudes of the plurality of applied signals and the measured signals from the valve actuator, and the adjusting of the timing of the injection signal to compensate for the at least one offset value.

21. The method of claim 20, wherein the plurality of applied signals are applied after the valve actuator is replaced.

22. The method of claim 21, wherein the measured signal from the valve actuator is measured in a free wheel circuit.

23. The method of claim 22, wherein the valve actuator is a solenoid.

24. The method of claim 23, wherein the plurality of applied signals are a plurality of currents applied to the solenoid.

25. The method of claim 20, wherein the adjusting of the timing of the injection signal maintains an end of an injection within a predetermined period of time.

26. A method for adjusting a signal delivered to a valve actuator of a fuel injector, comprising:

periodically applying a plurality of signals of different duration or magnitude to the valve actuator;

measuring a signal from the valve actuator for each of the applied signals, each measured signal from the valve actuator occurring after a termination of the associated applied signal and being indicative of a valve movement for the associated applied signal;

determining a valve movement time from at least the durations or magnitudes of the plurality of applied signals and the measured signals from the valve actuator;

determining at least one offset value by comparing the valve movement time to a reference profile; and adjusting the initiation or duration of an injection signal to the valve actuator based on the at least one offset value.

27. The method of claim 26, wherein the plurality of applied signals of different duration or magnitude include at least two signals of different duration and the same magnitude.

28. The method of claim 27, wherein the plurality of applied signals are applied after the valve actuator is replaced.

29. The method of claim 28, wherein the measured signal from the valve actuator is measured in a free wheel circuit.

30. The method of claim 29, wherein the valve actuator is a solenoid.

31. The method of claim 30, wherein the plurality of applied signals are a plurality of currents applied to the solenoid.

32. A computer readable medium, comprising:

instructions for applying a plurality of signals of different duration or magnitude to a valve actuator of a fuel injector;

measuring a signal induced by each of the applied signals, each induced signal being indicative of a valve movement for the associated applied signal; and adjusting an injection signal to the valve actuator based at least in part on the measured signals from the valve actuator.

33. The computer readable medium of claim 32, wherein the plurality of applied signals of different duration or magnitude include at least two signals of different duration and the same magnitude.

34. The computer readable medium of claim 33, wherein the adjusting of the injection signal to the valve actuator includes determining at least one offset value from at least the durations or magnitudes of the plurality of applied signals and the measured signals from the valve actuator, and the adjusting of the injection signal being related to the at least one offset value.

35. The computer readable medium of claim 34, wherein the plurality of applied signals are applied after the valve actuator is replaced.

36. The computer readable medium of claim 35, wherein the measured signal from the valve actuator is measured in a free wheel circuit.

37. The computer readable medium of claim 36, wherein the valve actuator is a solenoid.

38. The computer readable medium of claim 37, wherein the plurality of applied signals are a plurality of currents applied to the solenoid.

39. The computer readable medium of claim 38, wherein the adjusting of the injection signal to the valve actuator includes adjusting the timing and duration of the injection signal.

40. The computer readable medium of claim 32, wherein the induced signal is a voltage.

41. A method for adjusting a signal delivered to a valve actuator, comprising:

applying a plurality of signals of different duration or magnitude to the valve actuator;

measuring a signal induced by each of the applied signals, each induced signal being indicative of a valve movement for the associated applied signal;

determining a valve movement time from at least the durations or magnitudes of the plurality of applied signals and the measured signal from the valve actuator;

determining at least one offset value by comparing the valve movement time to a reference profile; and adjusting a start, duration, or end of an injection signal to the valve actuator based on the at least one offset value to maintain the end of an injection event within a predetermined period of time.

42. The method of claim 41, wherein the plurality of applied signals of different duration or magnitude include at least two signals of different duration and the same magnitude.

43. The method of claim 42, wherein the plurality of applied signals are applied after the valve actuator is replaced.

44. The method of claim 43, wherein the measured signal from the valve actuator is measured in a free wheel circuit.

45. The method of claim 44, wherein the valve actuator is a solenoid.

46. The method of claim 45, wherein the plurality of applied signals are a plurality of currents applied to the solenoid.

47. The method of claim 41, wherein the induced signal is a voltage.

* * * * *